US005110268A

United States Patent [19]

Sakurai et al.

[11] Patent Number: 5,110,268

[45] Date of Patent: May 5, 1992

[54] LUBRICANT SUPPLY SYSTEM OF A SCROLL FLUID MACHINE

[75] Inventors: Kazuo Sakurai, Shizuoka; Takahiro Tamura, Shimizu, both of Japan

[73] Assignee: Hitachi, Ltd., Tokyo, Japan

[21] Appl. No.: 620,613

[22] Filed: Dec. 3, 1990

[30] Foreign Application Priority Data

Dec. 4, 1989 [JP] Japan ..... 1-313347

[51] Int. Cl.[5] ..... F04B 17/00; F04B 35/04

[52] U.S. Cl. ..... 417/410; 418/55.6

[58] Field of Search ..... 417/410, 368; 418/55.6, 418/94; 184/6.16

[56] References Cited

U.S. PATENT DOCUMENTS 4,557,677 12/1985 Hasegawa ..... 417/410

4,946,361 8/1990 DeBlois et al. ..... 418/55.6

*Primary Examiner*—Richard A. Bertsch

*Assistant Examiner*—Alfred Basichas

*Attorney, Agent, or Firm*—Antonelli, Terry, Stout & Kraus

[57] ABSTRACT

A scroll compressor has a scroll mechanism disposed in a closed container and driven by a motor through a crank shaft rotatably supported at two points by first and second bearings disposed adjacent the opposite ends of the motor. The bearing which is remote from the scroll mechanism comprises a sliding bearing. The first end of the crank shaft remote from the scroll mechanism has a peripheral surface disposed in sliding engagement with the sliding bearing and formed therein with a lubricant supply groove communicated with an axial lubricant supply hole formed in the crank shaft and having a closed end adjacent the first end of the crank shaft and opened in an end face of a crank pin section thereof. The sliding bearing is communicated with a lubricant reservoir formed by a lower part of the container. The lubricant in the reservoir is subjected to the pressure of a compressed fluid discharged from the scroll mechanism and is forcibly fed into the lubricant supply groove through the sliding bearing.

6 Claims, 3 Drawing Sheets

LUBRICANT SUPPLY SYSTEM OF A SCROLL FLUID MACHINE

BACKGROUND OF THE INVENTION

The present invention relates to a lubricant supply system for a scroll fluid machine such as a compressor, an expander or a liquid pump.

A scroll compressor of the type in which a drive shaft is supported at both sides of an electric motor is disclosed in Japanese Patent Unexamined Publication No. 62-135676. In this known scroll compressor, the bearing mounted on a lower suspension structure of the compressor to support the lower portion of the drive shaft is lubricated with a part of lubricant which is suctioned by a pumping action effected by rotation of the drive shaft from a lubricant reservoir through a lubricant passage bore and then supplied to the bearing via lubricant supply holes formed in an inner race of the bearing past a passage hole and a peripheral groove. The remainder of the lubricant is supplied to the other bearing and other portions requiring lubrication.

Thus, in this lubricant supply system, the smoothness of the flow of the lubricant tends to be impaired due to the fact that a part of the lubricant is supplied to the bearing provided on the lower structure while the remainder is fed to the other bearing and other portions.

In addition, the lubricant supply system is required to have a complicated structure in order to distribute the lubricant to the bearings at rates which are optimum for the respective bearings.

Furthermore, this known lubricant supply system may fail to create the necessary supply pressure when the pumping effect is too low due to a low rotation speed of the drive shaft, particularly in the case where the operation speed of the rotary compressor is controlled by an inverter.

SUMMARY OF THE INVENTION

Accordingly, an object of the present invention is to provide a scroll compressor having a bearing lubricating system which is simple in construction but yet capable of ensuring optimum lubrication of the bearings.

Another object of the present invention is to provide a scroll compressor which can reliably and stably supply lubricant to a bearing which supports the end of the drive shaft remote from the scroll mechanism.

To these ends, according to the present invention, a scroll fluid machine is provided which includes a scroll mechanism disposed in a closed space and including a stationary scroll member and an orbiting scroll member cooperating with the stationary scroll member to define therebetween a scroll space, an electric motor disposed in the closed space, a drive shaft including a first portion axially extending through the rotor of the electric motor and fixed to the rotor and a second portion having a crank section drivingly connected to the orbiting scroll member to transmit the rotation of the rotor thereto. Bearing means are provided including a first bearing supporting supports the free end of the first portion of the drive shaft and a second bearing supporting a portion of the drive shaft between the first and second portions thereof. The first bearing comprises a sliding bearing, with the first portion of the drive shaft having peripheral surface slidingly contacting the sliding bearing. The peripheral surface includes a lubricant supply groove formed therein and opening at its one end in the end surface of the free end of the drive shaft and terminating at its other end in the peripheral surface. The drive shaft further includes an axial lubricant supply formed hole and a radial lubricant hole providing a communication between the lubricant supply groove and the axial lubricant supply hole. The axial lubricant supply hole is closed at the end adjacent the end surface of the drive shaft but opened in the end surface of the crank section. The scroll fluid machine further includes lubricant supply means for supplying a pressurized lubricant to the lubricant supply groove.

In a preferred embodiment of the present invention, the scroll mechanism is a compression mechanism for compressing a gaseous fluid. The compression mechanism, the drive shaft and the electric motor are arranged such that their longitudinal axes extend horizontally, with the bottom of the closed space forming a lubricant reservoir for the lubricant while the upper portion of the closed space communicates with a discharge port of the compression mechanism so that the pressure of the pressurized fluid discharged form the discharge Port of the compression mechanism acts on the lubricant in the lubricant reservoir. The scroll fluid machine further includes Passage means provided for communication between the lubricant reservoir and the lubricant supply groove. Consequently, the pressure of the pressurized fluid acting on the lubricant in the lubricant reservoir forces the lubricant into the oil supply groove through the passage means.

The above and other objects, features and advantages of the present invention will become more clear from the following description of the preferred embodiment with reference to the accompanying drawings.

DESCRIPTION OF THE PREFERRED EMBODIMENT

Figure 1:
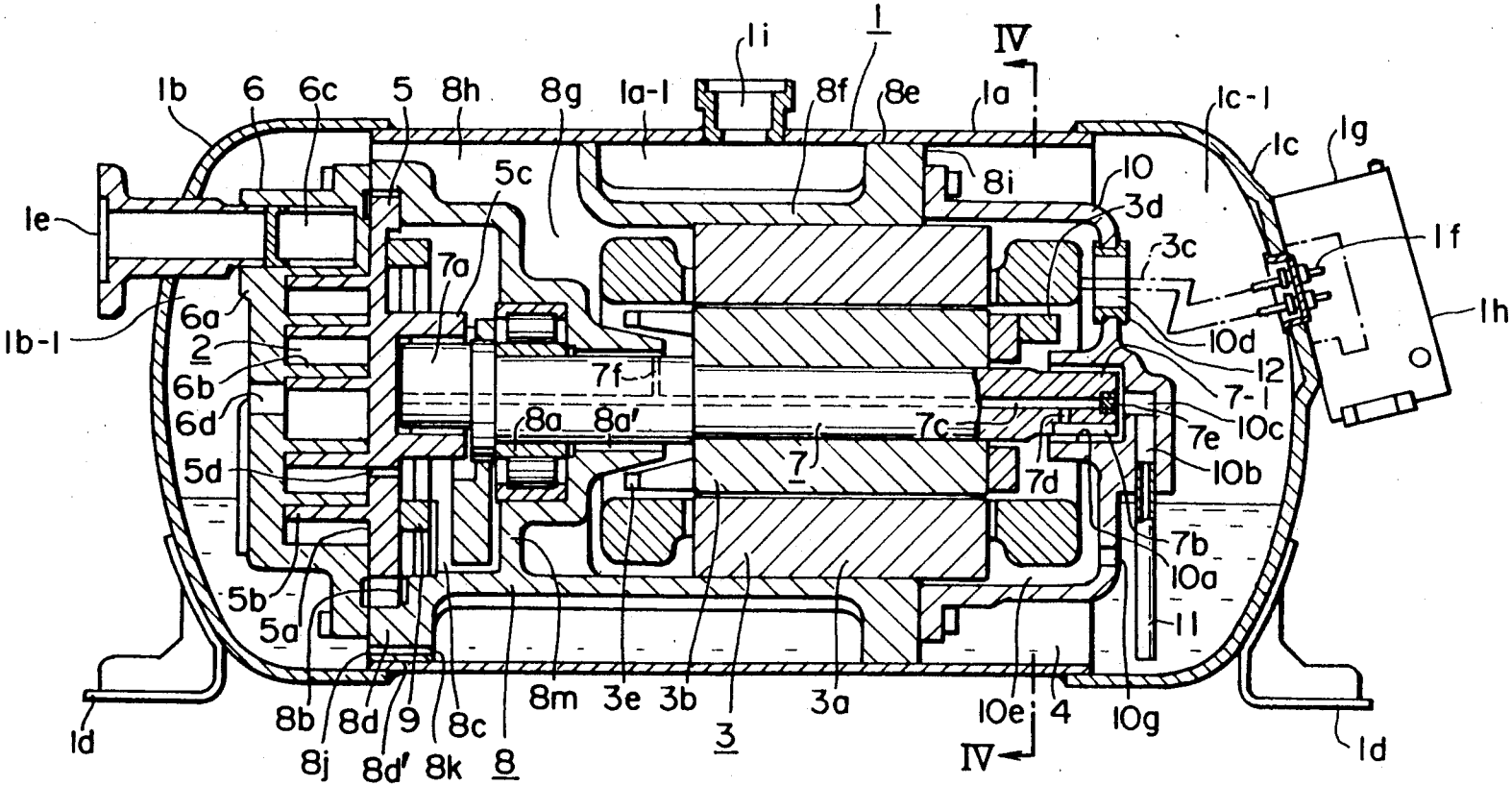
FIG. 1 is an axial sectional view of a scroll compressor embodying the present invention.

The compressor shown in FIG. 1 is a refrigerant compressor for compressing a refrigerant gas in, for example, an air conditioning system. The compressor has a substantially cylindrical closed container 1 composed of a cylindrical casing 1*a* and end caps 1*a* and 1*b* which close both open ends of the casing 1*a*. The container 1 accommodates a scroll compression mechanism 2, an electric motor 3 and a drive shaft 7 which is a crankshaft interconnecting the scroll compression mechanism 2 and the electric motor 3 such that the axes of the compression mechanism 2, the drive shaft 7 and the electric motor 3 extend horizontally. The lower end portion of the closed space inside the container 1 serves as a lubricant reservoir 4.

The compression mechanism 2 has an orbiting scroll member 5, a stationary scroll member 6 and a mechanism 9 for preventing the orbiting scroll member from rotating about its own axis. The orbiting scroll member 5 has a flat end plate 5*a* and a spiral wrap 5*b* on one surface of the end plate 5*a*. Similarly, the stationary scroll member 6 has an end plate 6*a* and a spiral wrap 6*b* on one surface of the end pate 6*a*. Both scroll members 5 and 6 are assembled together such that their wraps 5*b* and 6*b* mesh each other such that wrap spaces are formed between both scroll members 5 and 6 in a manner known. The drive shaft 7 has a crank pin section 7*a* on one end thereof. The crank pin section 7*a* is received in a bearing 5*c* which is provided on the surface of the end plate 5*a* of the orbiting scroll member 5 opposite to the wrap 5*b*. A pressure equalizer hole 5*d* is formed in the plate 5*a* so as to provide a communication between a wrap space in compression phase and a back-pressure chamber 8*c* which will be described later.

The stationary scroll member 6 is disposed in one 1*b* of the caps of the container 1. A suction port 6*c* is formed in a peripheral region of the end plate 6*a* outside the wrap 6*b*, while a discharge port 6*d* is formed in the central region of the end plate 6*a*. A suction port piece 1*e*, extending through and welded to the cap 1*b*, is connected to the suction port 6*c*.

Figure 4:
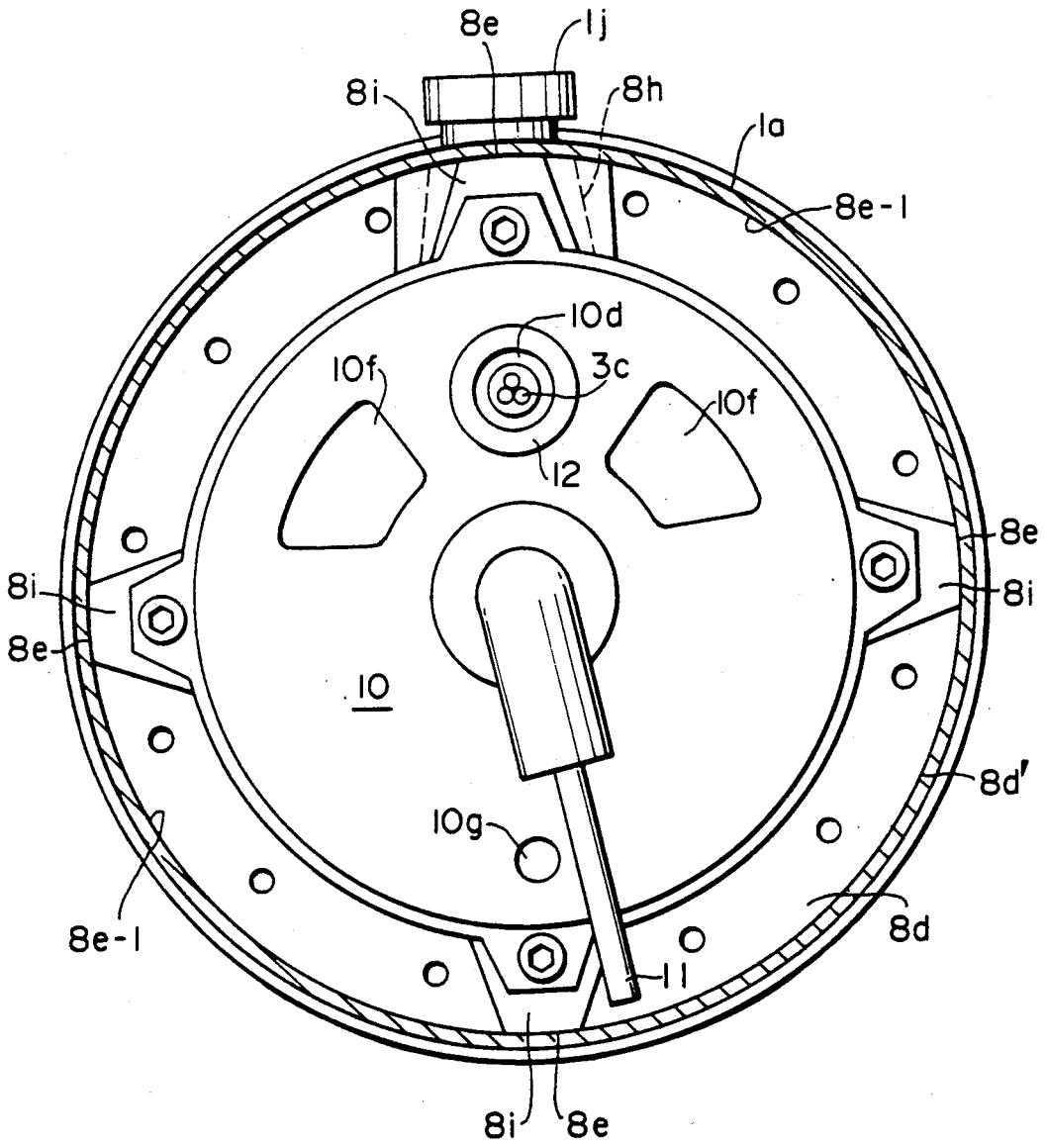
FIG. 4 is a cross-sectional view of the scroll compressor taken along the line IV—IV in FIG. 1.

Referring specifically to FIGS. 1 and 4, a frame 8 has a generally cylindrical form and is received in the casing 1*a* of the container 1 in close contact with the inner peripheral surface of the casing 1*a*. More specifically, one end 8*d* of the frame 8, which is the left end as viewed in FIG. 1, has a generally circular form with a notched portion which forms a passage 8*h* to be described later. The stationary scroll member 6 is fixed to the end surface of this circular end 8*d* of the frame 8 by means of bolts. The peripheral surface 8*d'* of the circular end 8*d* of the frame 8 closely contacts with the inner peripheral surface of the casing 1*a* of the container 1 so as to divide the space inside the container 1 into a chamber or a space 1*b*-1 adjacent the cap 1*b* and a chamber or a space 1*c*-1 adjacent the cap 1*c*. The discharge port 6*d* opens to the space 1*b*-1.

The other end of the frame 8, i.e., the right end as viewed in FIG. 1, has four radial projections 8*e* which are arranged at a constant circumferential pitch thereby forming a spider. The outer ends of the radial projections 8*e* of the spider closely contact with the inner peripheral surface of the casing 1*a*. A hat-shaped motor cover 10, forming a part of the frame 8, is fixed by bolts to the axially outer end surface 8*i* of the spider 8*e*. The motor cover 10 is disposed adjacent the space 1*c*-1.

The frame 8 has a cylindrical peripheral wall 8*f* of a diameter smaller than that of the inner peripheral surface of the casing 1*a*. The peripheral wall 8*f* is disposed between the spider 8*e* and the first-mentioned end 8*d* of the frame 8 and cooperates with the casing 1*a* to define therebetween an annular chamber 1*a*-1 which communicates with the aforementioned space 1*c*-1 through arcuate passages 8*e*-1 defined by the projections 8*e* of the spider and the casing 1*a* of the container 1. The annular chamber 1*a*-1 communicates at its lower portion with the space 1*b*-1 through a communication hole 8*k* formed in a lower region of the left end portion 8*d* of the frame 8. The casing 1*a* of the container 1 is provided with an outlet port 1*i* which communicates with the aforementioned annular chamber 1*a*-1.

The left end portion 8*d* of the frame 8 is recessed at its central region so as to receive the orbiting scroll member 5. The mechanism 9 for preventing the orbiting scroll member 5 from rotating about its own axis is disposed between the rear surface of the orbiting scroll 5 and the frame 8. A seat 8*b* is provided on the peripheral edge of the recess and supports the orbiting scroll member 5 in such a manner as to allow the orbiting scroll member 5 to make an orbiting movement relative to the stationary scroll member 6. The back-pressure chamber 8*c* is formed between the bottom 8*m* of the recess and the orbiting scroll member 5. The pressure in the back-pressure chamber 8*c* is maintained at an intermediate level equal to that of the refrigerant gas in a scroll space which is in midst of the compression phase. The pressure in the back-pressure chamber 8*c* acts on the rear side of the orbiting scroll member 5 so as to urge the same towards the stationary scroll member 6 with a proper force.

A bearing 8*a* is secured to the central portion of the bottom wall 8*m*. The axially outer end of the bearing 8*a* is exposed to the back-pressure chamber 8*c*. A sliding bearing 8*a'*, axially aligned with the bearing 8*a*, is formed on the center of the frame 8.

The electric motor 3 includes a stator 3*a* which fits on the inner peripheral surface of the peripheral wall 8*f* of the frame 8. The electric motor 3 also has a rotor 3*b* which is disposed radially inwardly of the stator 3*a* and fixed to the drive shaft 7. The drive shaft 7 extends axially through the rotor 3*b* and has a free end 7-1 projecting from one end surface of the rotor 3*a* towards the motor cover 10. This free end 7-1 of the drive shaft 7 is rotatably supported by a sliding bearing 10*a* formed in the center of the motor cover 10. The other end of the drive shaft 7 is formed by the crank pin section 7*a* mentioned before. Thus, the drive shaft 7 is also supported by the bearings 8*a* and 8*a'* at two points between the crank pin section 7*a* and the free end 7-1.

Figure 2:
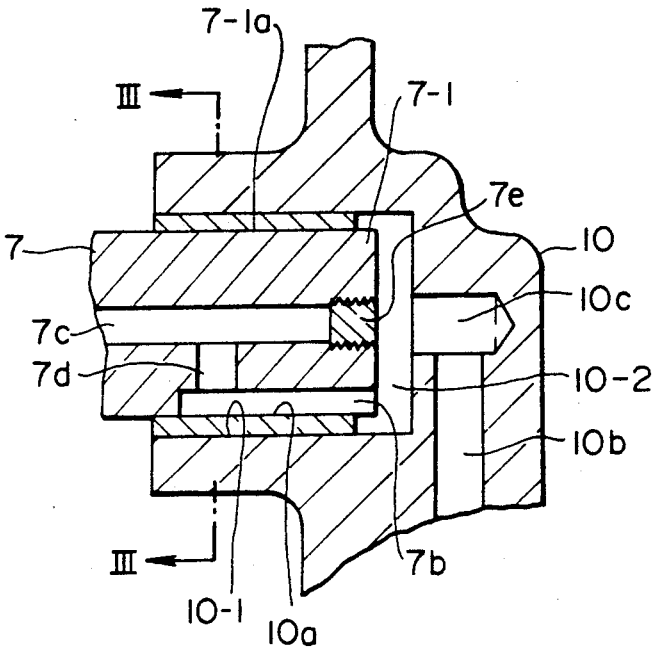
FIG. 2 is a fragmentary enlarged sectional view of the compressor shown in FIG. 1 showing a sliding bearing incorporated therein.
Figure 3:
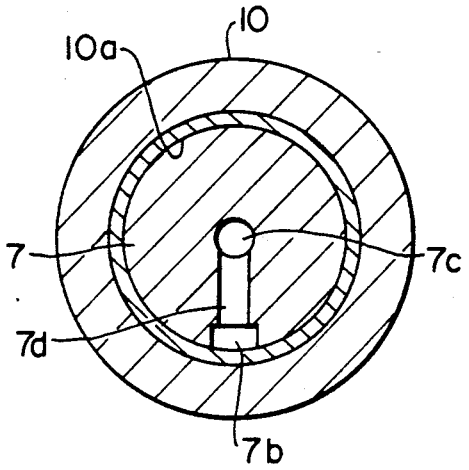
FIG. 3 is a cross-sectional view of the sliding bearing taken along the line III—III in FIG. 2.

Referring now to FIGS. 2 and 3, an axial lubricant supply groove 7*b* is formed in a peripheral surface 7-1*a* of the free end 7-1 of the drive shaft 7, which peripheral surface slidingly contacts with the sliding bearing 10*a* mentioned before. The lubricant supply groove 7*b* opens at its one end in the end surface of the free end 7-1 of the drive shaft 7, while the other end of the lubricant supply groove 7*b* terminates within a region of the peripheral surface 7-1*a*. The drive shaft 7 is also provided with an axial lubricant supply hole 7*c*, a first radial lubricant supply hole 7*d* providing a communication between the lubricant supply groove 7*b* and the axial lubricant supply hole 7*c*, and a second radial oil supply hole 7*f* through which the axial lubricant supply hole 7*c* is communicated with the sliding bearing 8*a'*. As will be seen from FIG. 1, the lubricant supply hole 7*c* opens in the end surface of the crank pin section 7*a*. The other end of this hole 7*c*, adjacent to the sliding bearing 10*a*, is closed by a screw 7*e*.

The sliding bearing 10*a* is received in a hole or recess 10-1 formed in the axially inner surface of the motor cover 10. A lubricant chamber 10-2 is formed between the bottom of the recess 10-1 and the end surface of the free end 7-1 of the drive shaft 7. An axial lubricant supply hole 10*c* formed in the bottom of the hole 10-1 communicates with the lubricant chamber 10-2. The motor cover 10 further has a pipe bore 10*b* communicating at its upper end with the lubricant hole 10*c* and connected at its lower end to the upper end of a lubricant pipe 11, the lower end of which opens in the lubricant reservoir 4 disposed in the bottom portion of the chamber 1*c*-1.

Referring again to FIG. 1, the motor cover 10 is further provided with a through-hole 10*d* for passing lead wires 3*c* through which the electric motor 3 is supplied with electric power. A lead-line protecting bushing 12 is secured to the peripheral edge of this through-hole 10*d*. A chamber 10*e* is formed between the motor cover 10 and the electric motor 3. The motor cover 10 further has a communication hole 10*g* which provides a communication between a lower part of the chamber 10*e* and the lubricant reservoir 4 on the bottom of the chamber 1*c*-1, and a pair of openings 10*f* through which the chamber 10*e* is communicated at its upper portion with the upper portion of the space 1*c*-1, as shown in FIG. 4.

A balance weight 3*d* is attached to the end of the rotor 3*b* of the electric motor 3 adjacent the sliding bearing 10*a*, while blades 3*e* are attached to the other end of the rotor 3*b*. The end of the rotor 3*b* carrying the blades 3*e* is exposed to a chamber 8*g* formed in the peripheral wall 8*f* of the frame 8 and communicating with the passage 8*h* formed in the frame 8.

Power terminals 1*f* connected to the leads 3*c* and terminal covers 1*g* and 1*h* are attached to the cap 1*c* of the container 1. Legs 1*d* are attached to the lower portions of both caps 1*b* and 1*c*.

As the electric motor 3 starts to operate, the drive shaft 7 rotates to cause the crank pin section 7*a* to revolve about the axis of the crank shaft 7, which in turn causes the orbiting scroll member 5 to make an orbiting movement. Meanwhile, the rotation of the orbiting scroll member 5 about its own axis is prevented by the mechanism 9. Consequently, the scroll space defined by the wraps 5*b* and 6*b* and end plates 5*a* and 6*a* of both scroll members 5 and 6 is progressively moved towards the center while decreasing its volume, so that the gas suctioned through the suction port 6*c* is compressed and discharged into the space 1*b*-1 through the discharge port 6*d*.

The discharged gas collides with the cap 1*b* so that lubricant content is separated from the gas. The gas is then introduced into the chamber 8*g* through the passage 8*h* formed in the frame 8. The gas is then diffused and cooled by the blades 3*e* provided on the rotor 8*b* and cools the electric motor 3 while flowing therethrough. The gas then flows into the space 1*c*-1 through the chamber 10*e* and the openings 10*f* in the motor cover 10 and further into the upper portion of the space 1*a*-1 through the passage 8*e*-1. The gas is finally discharged from the space 1*a*-1 to the exterior of the container 1 through the outlet port 1*i*.

During the operation of the compression mechanism 2, the gas compressed between both scroll members 5 and 6 produces a separating force which tends to urge both scroll members 5 and 6 away from each other. In order to prevent such a tendency, a part of the gas in the scroll chamber in its compression phase, compressed to an intermediate pressure level between the suction and discharge pressures, is introduced through the pressure equalizer hole 5*d* into the back-pressure chamber 8*c* so as to produce a force which acts to urge the orbiting scroll member 5 towards the stationary scroll member against the above-mentioned separating force.

Therefore, the bearing 5*c* of the orbiting scroll member 5 and the end surface of the bearing 8*a*' in the frame 8 adjacent to the back-pressure chamber 8*c* receive the intermediate pressure level, whereas the lubricant in the lubricant reservoir 4 receives the discharge pressure. Consequently, the lubricant is fed by the pressure differential between the discharge pressure and the intermediate pressure from the reservoir 4 to the end of the lubricant supply hole 7*c* adjacent the crank section 7*a* of the drive shaft 7 via the lubricant supply pipe 11 connected to the motor cover 10 and the lubricant supply hole 10*c*. As a result, the lubricant supply groove 7*b*, the lubricant supply hole 7*d* and the axial lubricant supply hole 7*c* are all filled with the lubricant, so that the sliding bearing 10*a* is supplied with the lubricant stably and without fail.

The lubricant in the axial lubricant supply hole 7*c* is further supplied therefrom to the bearings 8*a* and 8*a*' through the radial lubricant hole 7*f*. The bearing 5*c* is lubricated by the lubricant fed through the axial lubricant hole 7*c*.

Although the supply of the lubricant has been described as being effected satisfactorily by the pressure differential alone, it will be obvious to those in the art that the lubricant supply system of the invention can employ another suitable means such as an oil pump.

What is claimed is:

1. A scroll fluid machine comprising:

a compression mechanism for compressing a gaseous fluid disposed in a closed space and including a stationary scroll member and an orbiting scroll member cooperating with said stationary scroll member to define therebetween a scroll space;

an electric motor disposed in said closed space;

a drive shaft including a first portion axially extending through a rotor of said electric motor and fixed to said rotor and a second portion comprising a crank section drivingly connected to said orbiting scroll member; and bearing means including a first bearing comprising a sliding bearing for supporting a free end of said first portion of said drive shaft and a second bearing supporting a portion of said drive shaft between said first and second portions, said first portion of said drive shaft having a peripheral surface which slidingly contacts with said sliding bearing;

a lubricant supply groove formed in said peripheral surface and opening at one end in an end surface of said free end of said first portion of said drive shaft and terminating at an opposite within said peripheral surface;

an axial lubricant supply hole and a radial lubricant hole provided in said drive shaft for providing a communication between said lubricant supply groove and said axial lubricant supply hole;

lubricant supply means for supplying a pressurized lubricant through said lubricant supply groove to said sliding bearing and to said second bearing and through said radial lubricant hole and said axial lubricant supply hole;

wherein said axial lubricant supply hole is closed at one end adjacent said end surface of said drive shaft and opened in an end surface of said crank section;

a bottom of said closed space forms a lubricant reservoir for the lubricant, an upper portion of said closed space communicates with a discharge port of said pressure mechanism so that pressure of the pressurized fluid discharged through said discharge port of said compression mechanism acts on he lubricant in said lubricant reservoir; and wherein a passage means is provided for communicating said lubricant reservoir and said lubricant supply groove, whereby the pressure of said pressurized fluid forces the lubricant in said lubricant reservoir into said lubricant supply groove through said passage means.

2. A scroll fluid machine according to claim 1, further comprising a container defining said closed space therein and provided with a suction opening and an outlet opening, a frame for supporting said compression mechanism and said electric motor within said container, and a motor cover disposed in said container and attached to said frame so as to cover an end of said electric motor remote from said compressing mechanism;

said frame cooperating with said motor cover to divide said closed space into a first chamber adjacent said electric motor and communicating with sad outlet opening and a second chamber adjacent said compression mechanism;

said first bearing being disposed in said motor cover;

said second bearing being supported by said frame;

said stationary scroll member being fixed to said frame;

said orbiting scroll member being supported by said frame so as to be able to make an orbiting movement relative to said stationary scroll member;

said orbiting scroll member and said frame cooperating to define therebetween the back-pressure chamber communicating with said scroll space in a compression phase and also with one end of said second bearing;

said axial lubricant supply hole communicating with a second end of said second bearing;

said compression mechanism including a discharge port formed in said stationary scroll member so as to open to said second chamber;

said motor cover being provided with at least one opening formed therein so that the pressurized fluid discharged through said discharge port flows towards said outlet opening of said container through said second chamber, an interior of said electric motor and then through said first chamber while applying a pressure to the lubricant in said lubricant reservoir;

said motor cover including lubricant passage means providing a communication between said lubricant reservoir and said lubricant supply groove, whereby the lubricant is supplied from said lubricant reservoir to said lubricant supply groove through said lubricant passage means by a pressure differential between said first chamber and said back-pressure chamber.

3. A scroll compressor comprising:

a container entirely closed except for a suction opening and a discharge opening;

a compression mechanism, an electric motor and a drive shaft drivingly connecting said compression mechanism and said electric motor, said comprising mechanism, said electric motor and said drive shaft being accommodated in said container;

frame means for supporting said compression mechanism, said electric motor and said drive shaft within said container;

bearing means supported by said frame means and bearing said drive shaft; and lubricant supplying means for supplying a lubricating oil to said bearing means;

said compression mechanism including a stationary scroll member and an orbiting scroll member cooperating with said stationary scroll member to define therebetween a scroll space;

said drive shaft including a first portion extending through a rotor of said electric motor and fixed to said rotor and a second portion comprising a crankpin section drivingly connected to said orbiting scroll member;

said frame means dividing a space inside said container into a first space adjacent said electric motor and a second space adjacent said compression mechanism;

a bottom portion of said first space forming a lubricant reservoir for said lubricating oil;

said bearing means including a first bearing for supporting a free end of said first portion of said drive shaft and a second bearing for supporting a portion of said drive shaft between said first and second portions;

said compression mechanism having a discharge port opening to said second space;

means for introducing a pressurized gas, discharged into said second space through said discharge port, into said first space to that said first space is maintained at a first pressure level;

said lubricant supply means including a first lubricant passage means providing a communication between said lubricant reservoir and said first bearing and a second lubricant passage means providing a communication between said first bearing and one end of said second bearing;

said first bearing comprising a sliding bearing for rotatably supporting a peripheral surface of said free end of said first portion of said drive shaft;

said second lubricant passage means including a lubricant groove formed in said peripheral surface and a substantially axial lubricant supply hole formed in said drive shaft in communication with said lubricant supply groove;

a second end of said second bearing receiving a second pressure level lower than said first pressure level in said first space, whereby the lubricant in said lubricant reservoir is forced to said first and second bearings by a pressure differential between said first and second pressure levels.

4. A scroll compressor according to claim 3, wherein said orbiting scroll member is supported by said frame means so as to be able to make an orbiting movement relative to said stationary scroll member, and wherein a back pressure chamber is formed between said orbiting scroll member and said frame means in communication with a scroll space which is in a compression phase and also with said the second end of said second bearing.

5. A scroll compressor according to claim 3, wherein said compression mechanism is adapted to compress a refrigerant gas, and lubricating oil contained in the pressurized refrigerant gas discharged from said compression mechanism into said second space is separated from said refrigerant gas in said second space and collected at a bottom of said second space, said second space communicating at said bottom of said second space with said lubricant reservoir in said first space.

6. A scroll compressor according to claim 5, wherein said discharge opening opens to an upper portion of said first space, and wherein said frame means is so constructed as to introduce the pressurized refrigerant gas after separation of the lubricating oil therefrom, into said first space through said electric motor and then into said discharge opening.

* * * * *